US010066412B2

(12) United States Patent
Tsai et al.

(10) Patent No.: US 10,066,412 B2
(45) Date of Patent: Sep. 4, 2018

(54) EQUIPMENT PROTECTION SYSTEM AND PROTECTION DEVICE THEREOF

(71) Applicant: Winbond Electronics Corp., Taichung (TW)

(72) Inventors: Yao-Huang Tsai, Taichung (TW); Ming-Yen Lin, Taichung (TW)

(73) Assignee: Winbond Electronics Corp., Taichung (TW)

( * ) Notice: Subject to any disclaimer, the term of this patent is extended or adjusted under 35 U.S.C. 154(b) by 0 days.

(21) Appl. No.: 15/384,852

(22) Filed: Dec. 20, 2016

(65) Prior Publication Data

US 2017/0356214 A1 Dec. 14, 2017

(30) Foreign Application Priority Data

Jun. 14, 2016 (TW) ..... 105118516 A

(51) Int. Cl.

| | |
|---|---|
| ***E05F 15/20*** | (2006.01) |
| ***E04H 9/02*** | (2006.01) |
| ***E04F 10/06*** | (2006.01) |
| ***E06B 9/88*** | (2006.01) |

(52) U.S. Cl.

CPC ..... *E04H 9/029* (2013.01); *E04F 10/0648* (2013.01); *E04F 10/0659* (2013.01); *E06B 9/88* (2013.01); *E04F 10/06* (2013.01); *E04F 10/0618* (2013.01); *E04F 10/0651* (2013.01)

(58) Field of Classification Search

CPC .. E04H 9/029; E04F 10/0659; E04F 10/0648; E06B 9/88; E06B 9/84; E06B 9/80

USPC ..... 160/9

See application file for complete search history.

(56) References Cited

U.S. PATENT DOCUMENTS

| | | | | | |
|---|---|---|---|---|---|
| 166,618 | A | * | 8/1875 | Lussenhop | |
| 330,956 | A | * | 11/1885 | Brenner | |
| 405,475 | A | * | 6/1889 | Hohorst | |
| 4,301,851 | A | * | 11/1981 | Gitkin | E06B 9/92 160/129 |
| 4,655,010 | A | * | 4/1987 | Arquati | E04F 10/0607 160/266 |
| 5,195,594 | A | * | 3/1993 | Allen | A62C 2/10 160/243 |

(Continued)

FOREIGN PATENT DOCUMENTS

| | | | |
|---|---|---|---|
| CN | 202151236 | U | 2/2012 |
| CN | 102729095 | A | 10/2012 |

(Continued)

*Primary Examiner* — Katherine W Mitchell
*Assistant Examiner* — Jeremy C Ramsey
(74) *Attorney, Agent, or Firm* — Muncy, Geissler, Olds & Lowe, P.C.

(57) ABSTRACT

A protection device is provided, including a first fixed member, a second fixed member, a supporting member, a roller, an awning, an electromagnetic device, and a power supply unit. The supporting member connects to the first and second fixed members. The roller is movably disposed on the supporting member. The power supply unit provides electrical power to the electromagnetic device, so that the electromagnetic device attracts the roller, and the awning remains in a received state. When the power supply unit stops providing electrical power to the electromagnetic device, the roller moves along the supporting member, and the awning is expanded to cover the equipment.

10 Claims, 13 Drawing Sheets

(56) References Cited

U.S. PATENT DOCUMENTS

| | | | | | |
|---|---|---|---|---|---|
| 5,259,432 | A * | 11/1993 | Danieli | E04F 10/0607 | 160/277 |
| 5,355,927 | A * | 10/1994 | McKeon | A62C 2/24 | 160/133 |
| 5,794,679 | A * | 8/1998 | Williams | E04F 10/02 | 160/46 |
| 7,000,668 | B2 * | 2/2006 | Sears | E06B 9/13 | 160/2 |
| 7,299,848 | B2 * | 11/2007 | Streib | A62C 2/247 | 160/243 |
| 7,735,539 | B2 * | 6/2010 | Nakamura | A62C 2/10 | 160/243 |
| 7,748,429 | B2 * | 7/2010 | Caire | E04F 10/0607 | 160/113 |

FOREIGN PATENT DOCUMENTS

| | | | |
|---|---|---|---|
| CN | 203509361 | U | 4/2014 |
| CN | 204060457 | U | 12/2014 |
| CN | 204771830 | U | 11/2015 |
| EP | 0713436 | B1 | 10/1997 |
| JP | 2008290221 | A | 12/2008 |

* cited by examiner

EQUIPMENT PROTECTION SYSTEM AND PROTECTION DEVICE THEREOF

CROSS REFERENCE TO RELATED APPLICATIONS

This Application claims priority of Taiwan Patent Application No. 105118516, filed on Jun. 14, 2016, the entirety of which is incorporated by reference herein.

BACKGROUND OF THE DISCLOSURE

Field of the Invention

The present invention relates to a protection device, and in particular it relates to a protection device having an expandable awning which can be automatically expanded when a power supply unit stops providing electrical power.

Description of the Related Art

To meet fire safety regulations, factory employed in semiconductor wafer fabrication are usually equipped with emergency fitted sprinkler systems. However, when a natural disaster such as an earthquake happens, the fire main that runs along the ceiling of the facility may crack or break, causing water to leak and damage the wafer fabrication equipment and other important devices.

The protection devices currently used in semiconductor wafer fabrication factories are usually operated by the operators, and the awning can be expanded above the equipment to provide protection. However, these protection devices can not be operated without electricity, which is often lost in the event of an earthquake.

BRIEF SUMMARY OF THE DISCLOSURE

An embodiment of the invention provides a protection device for equipment disposed on a floor. The protection device comprises a first fixed member, a second fixed member, a supporting member, a roller, an awning, an electromagnetic device, and a power supply unit. The first fixed member is fixed to the floor and situated on one side of the equipment. The second fixed member is fixed to the floor and situated on the other side of the equipment. The supporting member is disposed above the equipment and connected to the first and second fixed members, wherein the supporting member is tilted relative to the floor. The roller is movably disposed on the supporting member, and has magnetic material. The awning is wound on the roller and situated in a received state, wherein a first side of the awning is fixed to the first fixed member, a second side of the awning is fixed to the roller, and the second side is opposite to the first side. The electromagnetic device is disposed on a side of the first fixed member. The power supply unit provides electrical power to the electromagnetic device, so that the electromagnetic device attracts the roller, and the awning remains in the received state. When the power supply unit stops providing electrical power to the electromagnetic device, the roller moves along the supporting member due to gravity, and the awning is expanded to cover the equipment.

An embodiment of the invention further provides a protection device for equipment disposed on a floor. The protection device comprises a fixed member, a linkage mechanism, a retractable member, an awning, an electromagnetic device, and a power supply unit. The fixed member is fixed to the floor and situated on one side of the equipment. The linkage mechanism is situated above the equipment and connected to the fixed member, wherein the linkage mechanism has magnetic material. The retractable member is connected to the linkage mechanism. The awning is disposed on the linkage mechanism and situated in a received state, wherein a first side of the awning is fixed to the fixed member, a second side of the awning is fixed to the linkage mechanism, and the second side is opposite to the first side. The electromagnetic device is disposed on a side of the first fixed member. The power supply unit is providing electrical power to the electromagnetic device, so that the electromagnetic device attracts the linkage mechanism, and the awning remains in the received state. When the power supply unit stops providing electrical power to the electromagnetic device, the retractable member expands the linkage mechanism, and the awning is expanded to cover the equipment.

An embodiment of the invention further provides an equipment protection system. The equipment protection system comprises a protection device, a power source, and an earthquake sensor. The protection device as mentioned previously. The power source is electrically connected to the power supply unit of the protection device. The earthquake sensor is electrically connected to the power source. When the earthquake sensor detects a seismic intensity greater than a specific value, the earthquake sensor transmits a signal to the power source, and the power source stops providing electrical power to the power supply unit.

A detailed description is given in the following embodiments with reference to the accompanying drawings.

BRIEF DESCRIPTION OF THE DRAWINGS

For a more complete understanding of the embodiments, and the advantages thereof, reference is now made to the following descriptions taken in conjunction with the accompanying drawings.

DETAILED DESCRIPTION OF THE ILLUSTRATIVE EMBODIMENTS

The following description is of the best-contemplated mode of carrying out the invention. This description is made for the purpose of illustrating the general principles of the invention and should not be taken in a limiting sense. The scope of the invention is best determined by reference to the appended claims.

Further, spatially relative terms, such as "beneath," "below," "lower," "above," "upper" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. For example, if the device in the figures is turned over, elements described as being "below" or "beneath" other elements or features would then be oriented "above" the other elements or features. Thus, the exemplary term "below" can encompass both an orientation of above and below. The apparatus may be otherwise oriented (rotated 90 degrees or at other orientations) and the spatially relative descriptors used herein may likewise be interpreted accordingly.

Figure 1A:
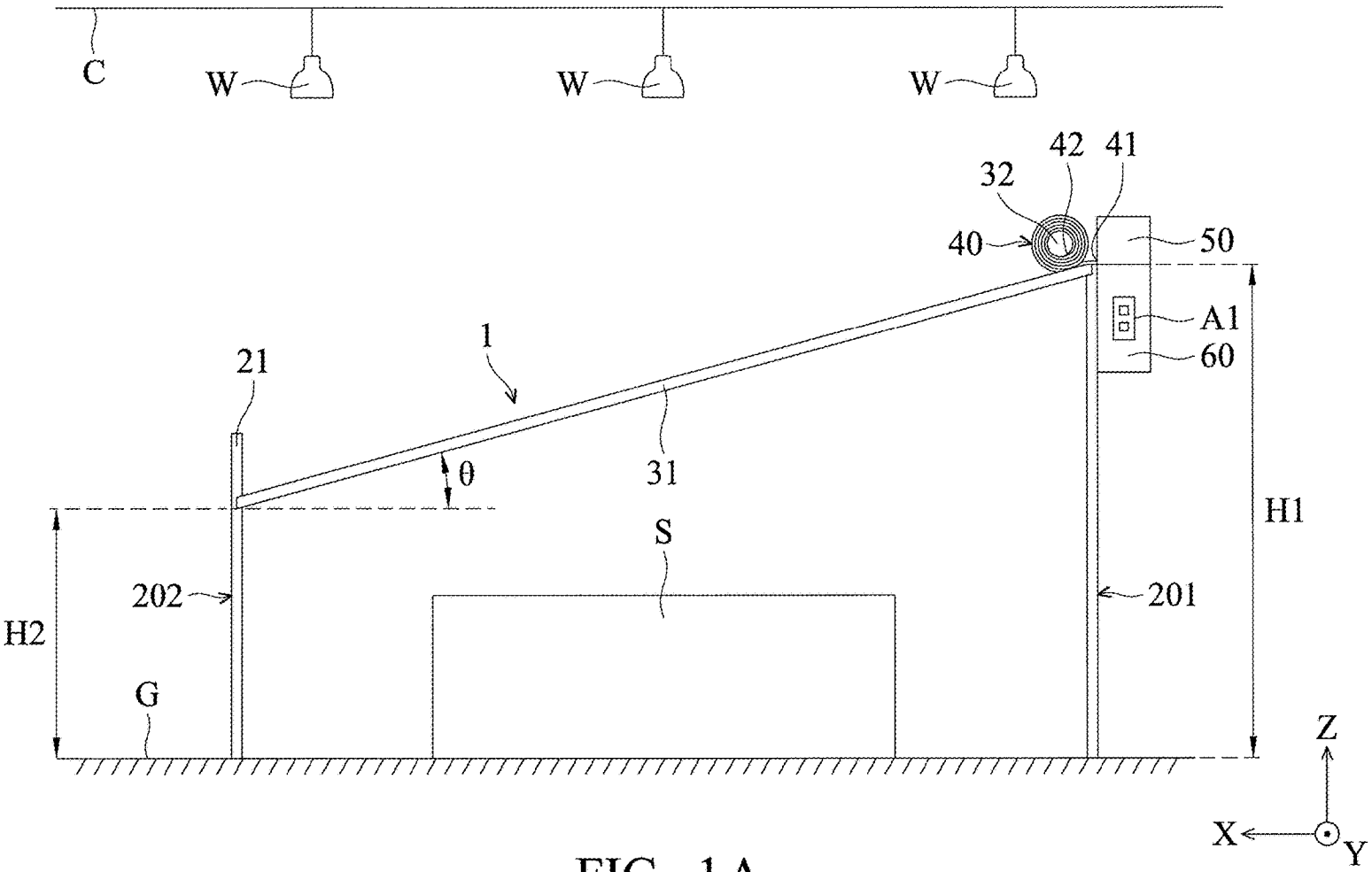
FIG. 1A is a front view of a protection device and equipment according to an embodiment of the invention.
Figure 1B:
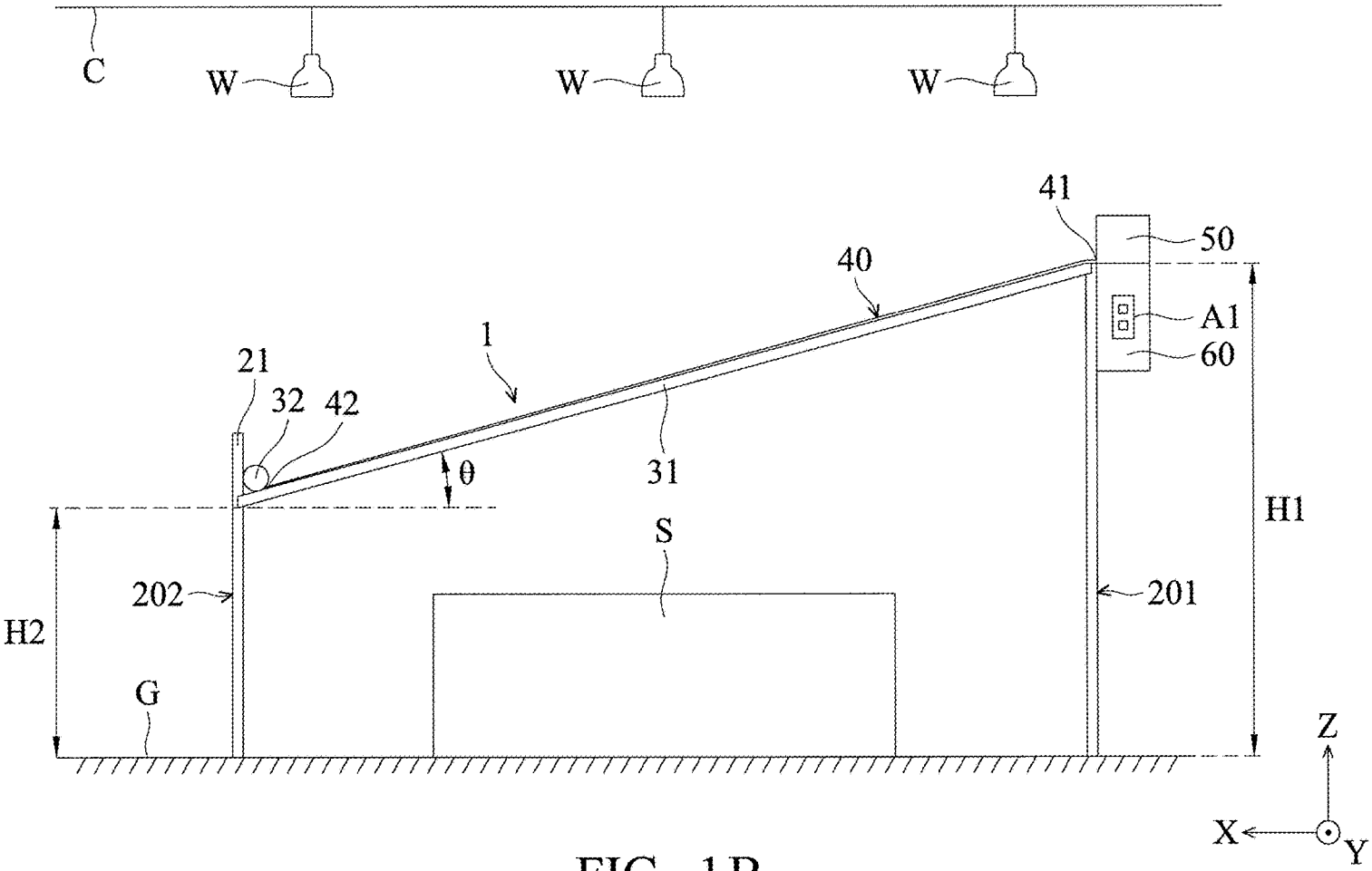
FIG. 1B is a front view of the protection device and equipment when the awning is expanded.

Referring to FIGS. 1A and 1B, FIG. 1A is a front view of a protection device 1 and equipment S according to an embodiment of the invention, and FIG. 1B is another front view of the protection device 1 and equipment S when the awning 40 is expanded. As shown in FIG. 1A, the equipment S in this embodiment is on the floor G, and the protection device 1 primarily comprises a first fixed member 201, a second fixed member 202, a supporting member 31, a roller 32, an awning 40, an electromagnetic device 50, and a power supply unit 60. The first fixed member 201 is fixed to the floor G and situated to a side of the equipment S. The second fixed member 202 is fixed to the floor G and situated to the other side of the equipment S. The supporting member 31 is disposed above the equipment S and is connected to the first and second fixed members 201 and 202.

Specifically, the roller 32 is movably disposed on the supporting member 31 and comprises magnetic material. The awning 40 is wound on the roller 32 and remains in a received state. The electromagnetic device 50 and the power supply unit 60 are disposed on a side of the first fixed member 201, wherein the power supply unit 60 provides electrical power to the electromagnetic device 50, so that the electromagnetic device 50 attracts the roller 32 and retains the awning 40 in the received state, as shown in FIG. 1A.

It is clear in FIG. 1A that the supporting member 31 is connected to the first fixed member 201 at a first height H1, and the supporting member 31 is connected to a second fixed member 202 at the second height H2. As the first height H1 is greater than the second height H2, the supporting member 31 forms an inclined angle θ with respect to the floor G, and the angle θ is an acute angle in this embodiment.

It should be understood that a top end of the second fixed member 202 forms a restricting portion 21 protruding upwardly from the supporting member 31. When the roller 32 moves toward the second fixed member 202 with respect to the supporting member 31, the restricting portion 21 can restrict the roller 32 between the first and second fixed members 201 and 202 to prevent the roller 32 from falling to the floor G, as shown in FIG. 1B. Moreover, the power supply unit 60 has a first switch A1 to control the power supply unit 60 and provide electrical power to the electromagnetic device 50. A first end 41 of the awning 40 is fixed to the first fixed member 201, and a second end 42 of the awning 40 is fixed to the roller 32, wherein the second end 42 is opposite to the first end 41.

In some embodiments, the awning 40 may comprise non-combustible and non-combustion-supporting material, such as glass fabric material. The equipment S can be any equipment in which incursion of liquid or dust should be avoided, such as semiconductor wafer fabrication equipment. A plurality of sprinklers W can be disposed on the ceiling C above the protection device 1. When an earthquake or another emergency occurs, the operator can turn off the power supply unit 60 through the first switch A1 to stop providing the electrical power to the electromagnetic device 50. Thus, the magnetic force between the electromagnetic device 50 and the roller 32 is released, so that the roller 32 moves along the supporting member 31 due to gravity until it contacts the restricting portion 21 (FIG. 1B). Here, the awning 40 is expanded on the supporting member 31 to cover the equipment S, so that the liquid or dust can be prevented from intruding into the equipment S.

Figure 2A:
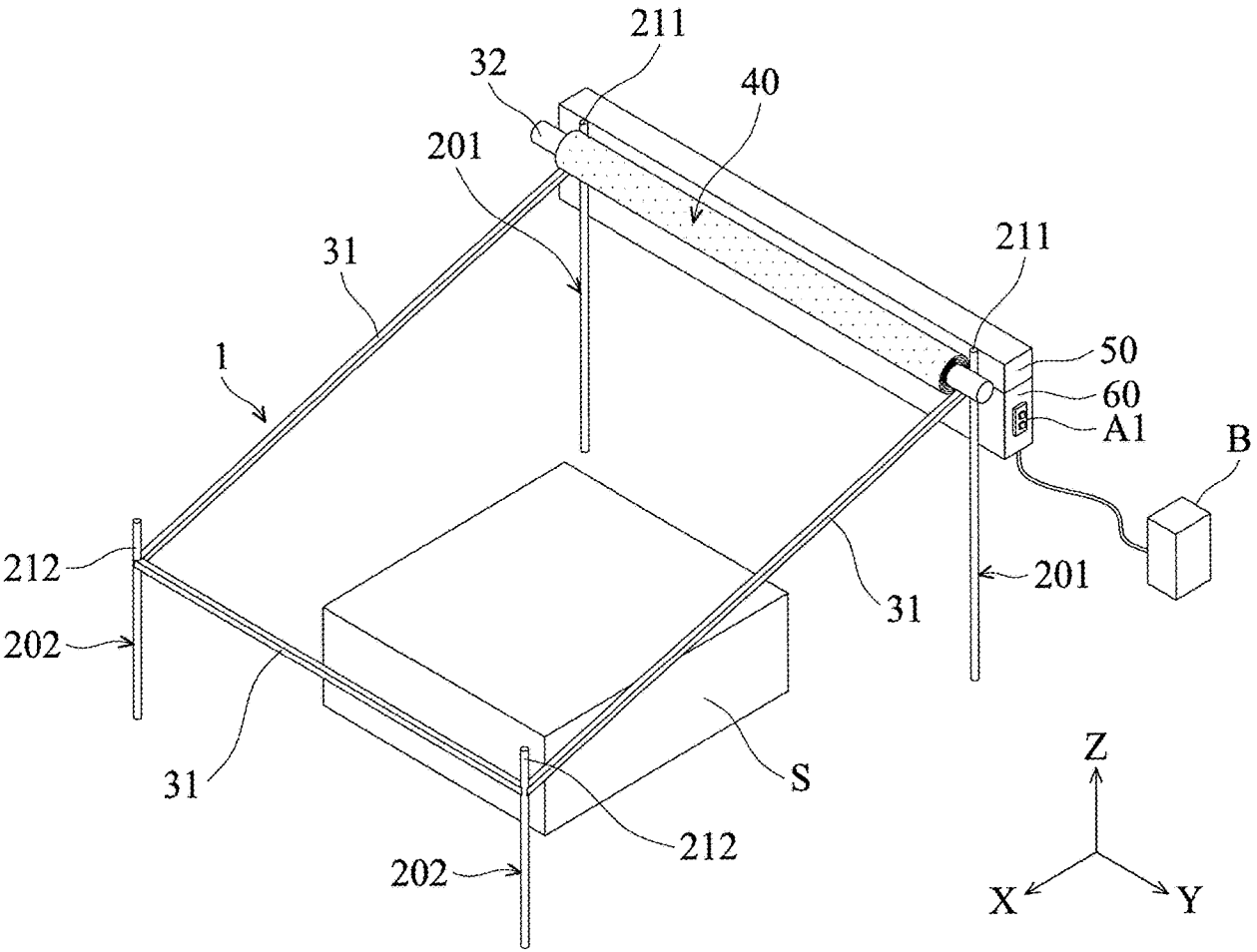
FIG. 2A is a perspective view of a protection device, equipment, and an earthquake sensor according to another embodiment.
Figure 2B:
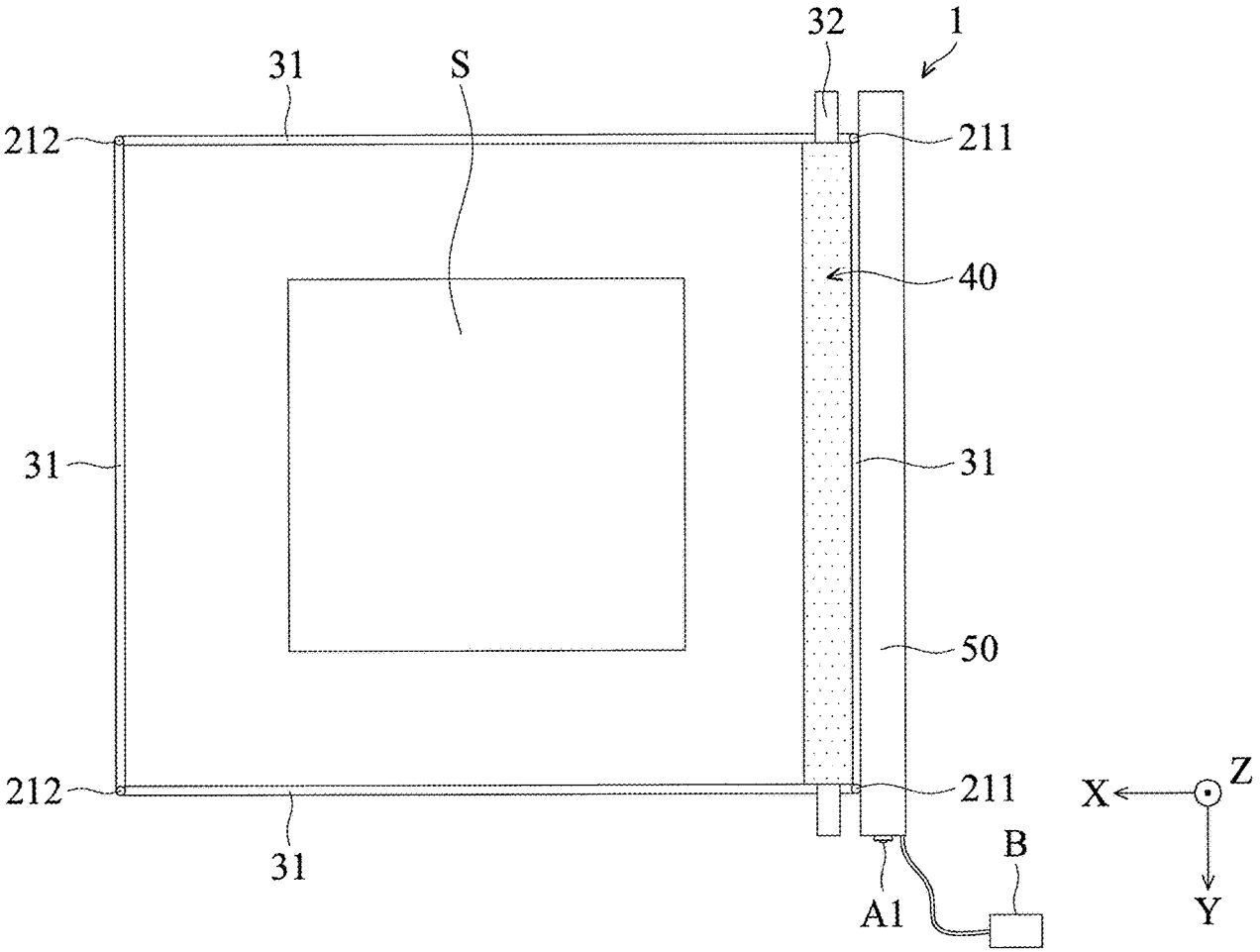
FIG. 2B is a top view of the protection device, the equipment, and the earthquake sensor in FIG. 2A.
Figure 2C:
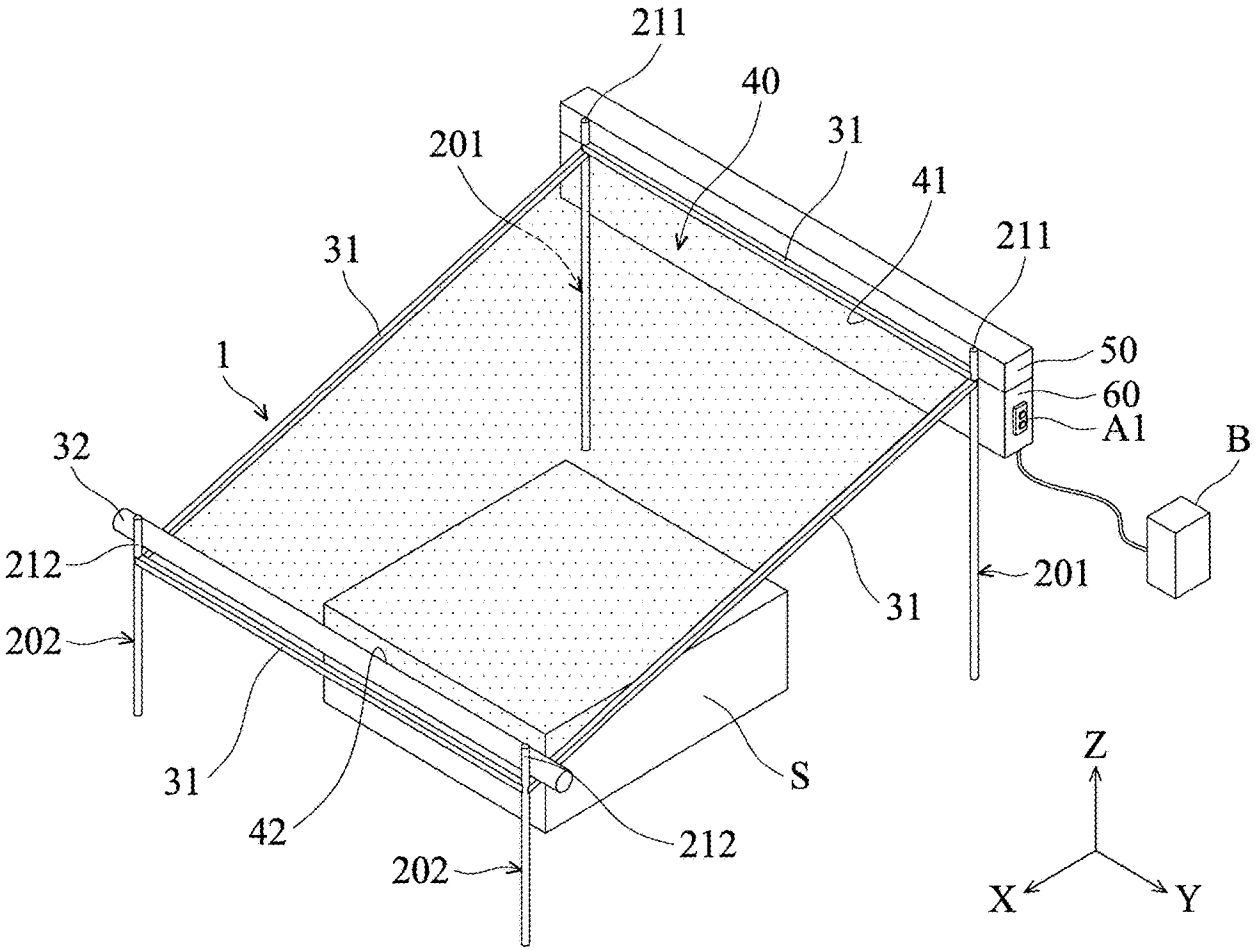
FIG. 2C is a perspective view the protection device, the equipment, and the earthquake sensor when the awning is expanded.
Figure 2D:
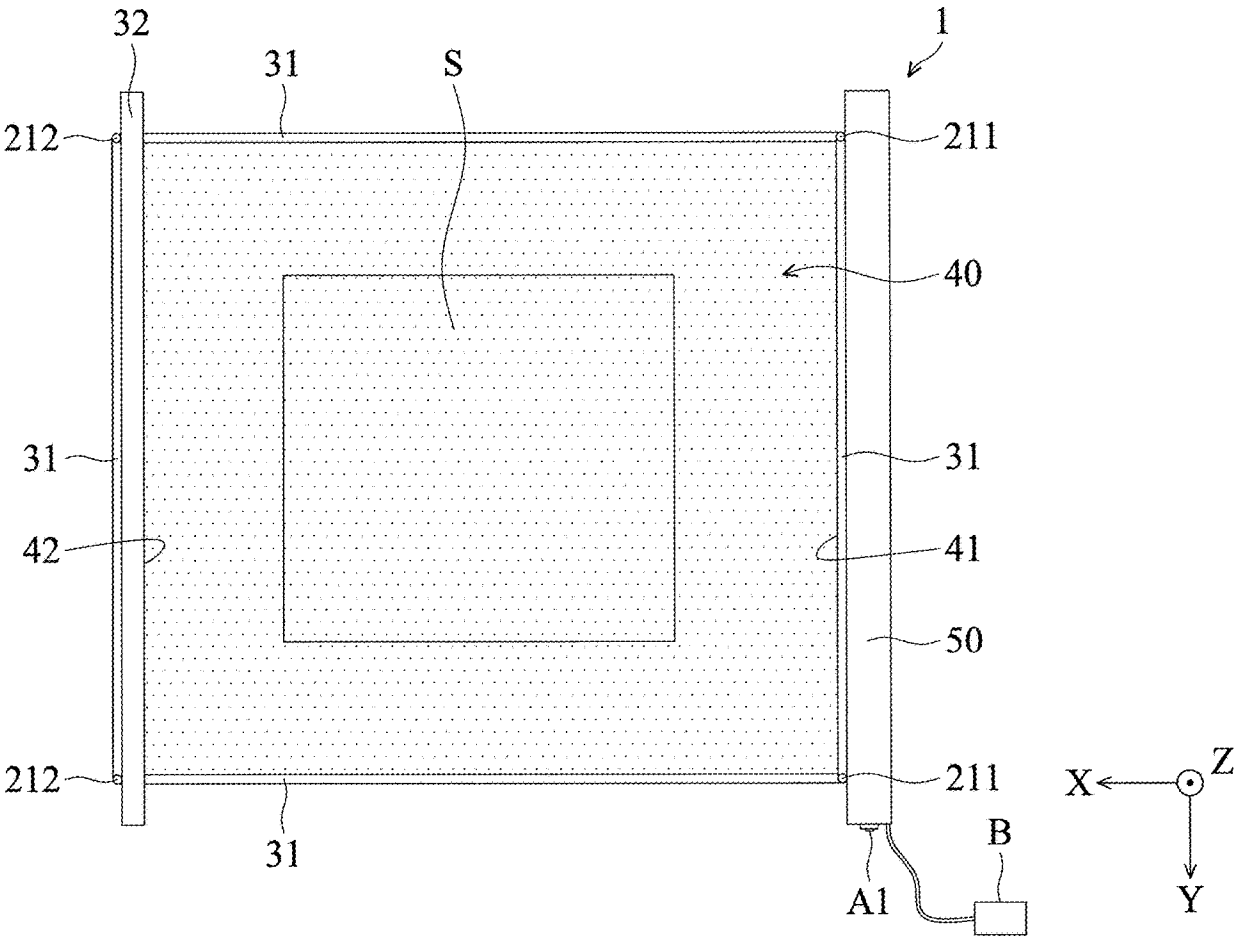
FIG. 2D is a top view of the protection device, the equipment, and the earthquake sensor in FIG. 2C.

Referring to FIGS. 2A-2D, FIG. 2A is a perspective view of a protection device 1, equipment S, and an earthquake sensor B according to another embodiment, and FIG. 2B is a top view of the protection device 1, the equipment S and the earthquake sensor B in FIG. 2A. Moreover, FIG. 2C is a perspective view the protection device 1, the equipment S, and the earthquake sensor B when the awning 40 is expanded, and FIG. 2D is a top view of the protection device 1, the equipment S and the earthquake sensor B in FIG. 2C. As shown in FIGS. 2A-2D, the protection device 1 primarily comprises two first fixed members 201, two second fixed members 202, four supporting members 31, a roller 32, an awning 40, an electromagnetic device 50, and a power supply unit 60.

It should be noted that the difference between this embodiment and the embodiment of FIG. 1A is that the protection device 1 in this embodiment comprises two first fixed members 201, two second fixed members 202, and four supporting members 31. As shown in FIGS. 2A and 2C, the first fixed members 201 are disposed on a side of the equipment S, and the second fixed member 202 is disposed on the opposite side of the equipment S, and the supporting members 31 are disposed above the equipment S and are connected to the first and second fixed members 201, 202. The first and second fixed members 201 and 202 respectively have a restricting portion 211 and 212 which are configured to restrict the roller 32 moving between the first and second fixed members 201 and 202, so that the roller 32 will not fall to the floor G. It is clearly shown in FIGS. 2B and 2D that the four supporting members 31 form a rectangle area, wherein the equipment S is in a region where the rectangle area is projected onto the floor G. In addition, the awning 40 has a substantially rectangular structure and completely covers the equipment S when expanded (as shown in FIG. 2D).

It should be understood that the power supply unit 60 in this embodiment is electrically connected to an earthquake sensor B. When the earthquake sensor B detects a seismic intensity greater than a specific value, the earthquake sensor B transmits a signal to the power supply unit 60, so that the power supply unit 60 stops providing electrical power to the electromagnetic device 50. In some embodiments, when an earthquake with a seismic intensity greater than 4 scales occurs and the liquid in the fire pipe of the sprinkler W leaks, the power supply unit 60 can receive a signal from the earthquake sensor B and stop providing electrical power to the electromagnetic device 50, so that the awning 40 is expanded above the supporting members 31 and covers the equipment S. Moreover, the operator can also turn off the power supply unit 60 through the first switch A1 to stop providing electrical power to the electromagnetic device 50. It should be noted that the rectangle structure formed by the supporting members 31 can be integrally formed in one piece, and the invention does not limit the structure of the awning 40 and the supporting members 31 to being rectangular: it can also be trapezoidal, a parallelogram, or another shape, based on demand.

Figure 3A:
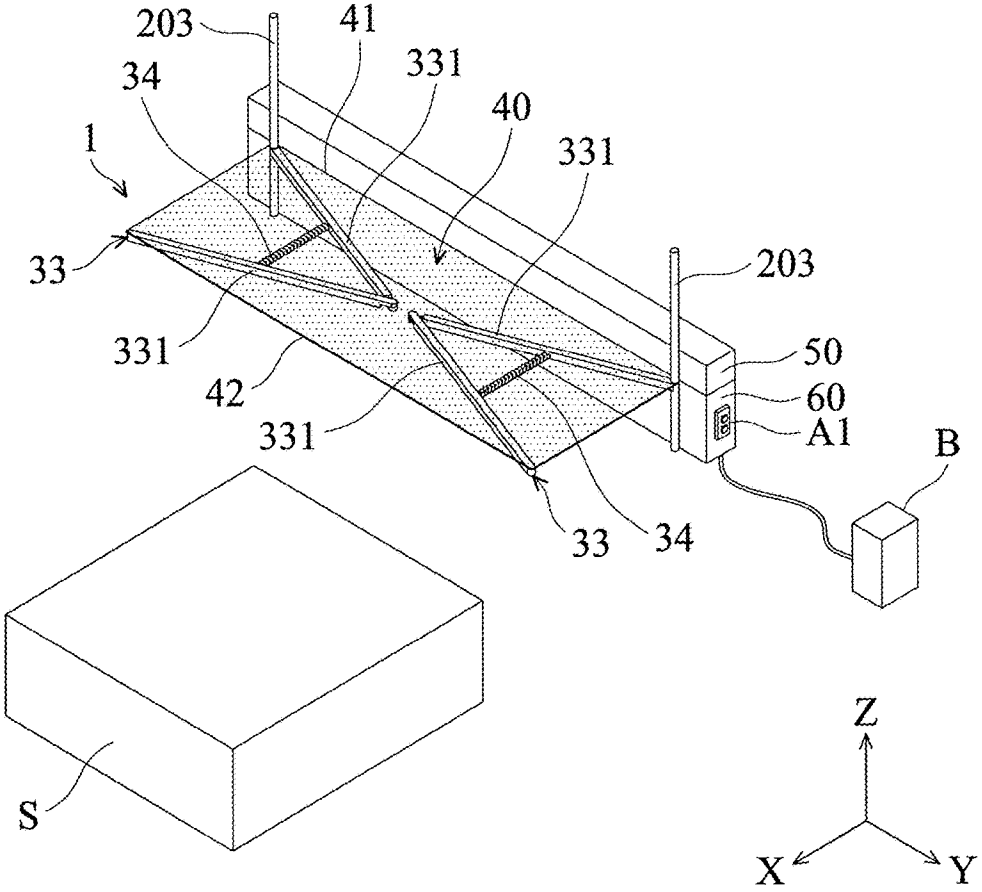
FIG. 3A is a perspective view of a protection device, an equipment, and an earthquake sensor according to another embodiment of the invention.
Figure 3B:
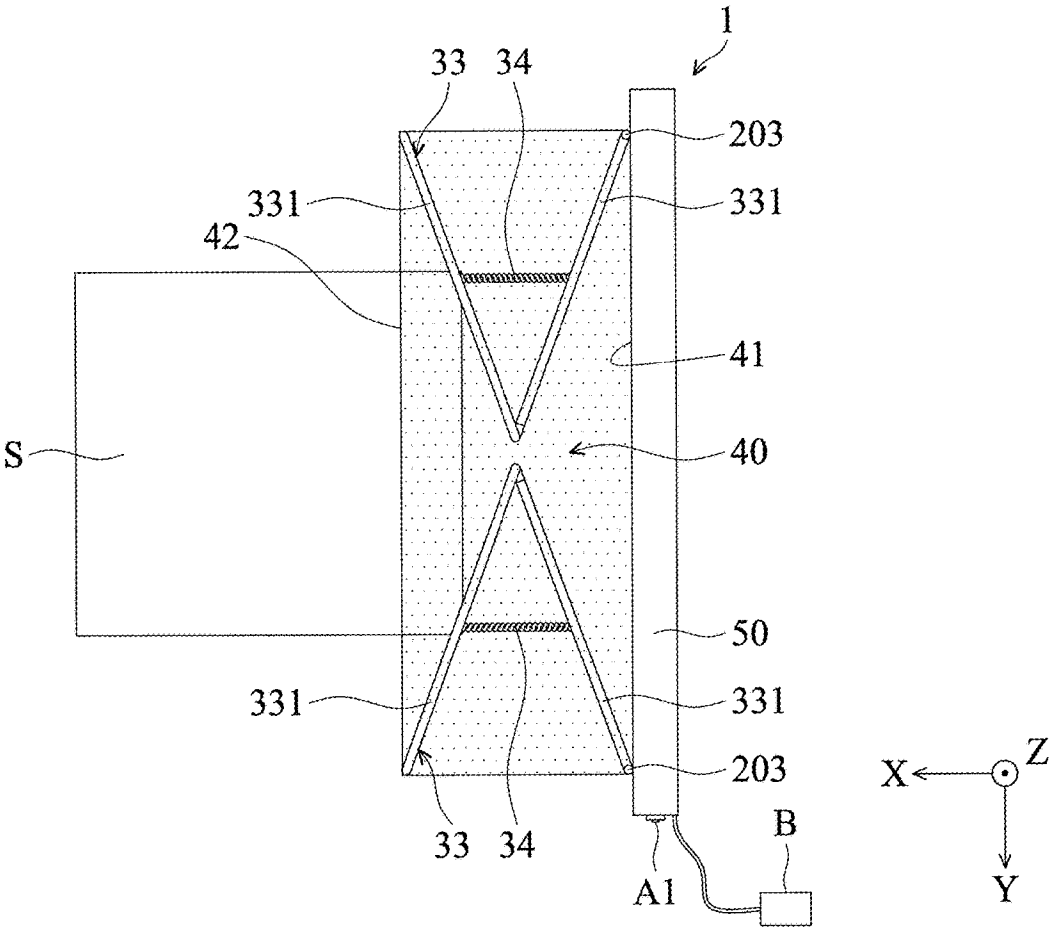
FIG. 3B is a top view of the protection device, the equipment, and the earthquake sensor in FIG. 3A.
Figure 3C:
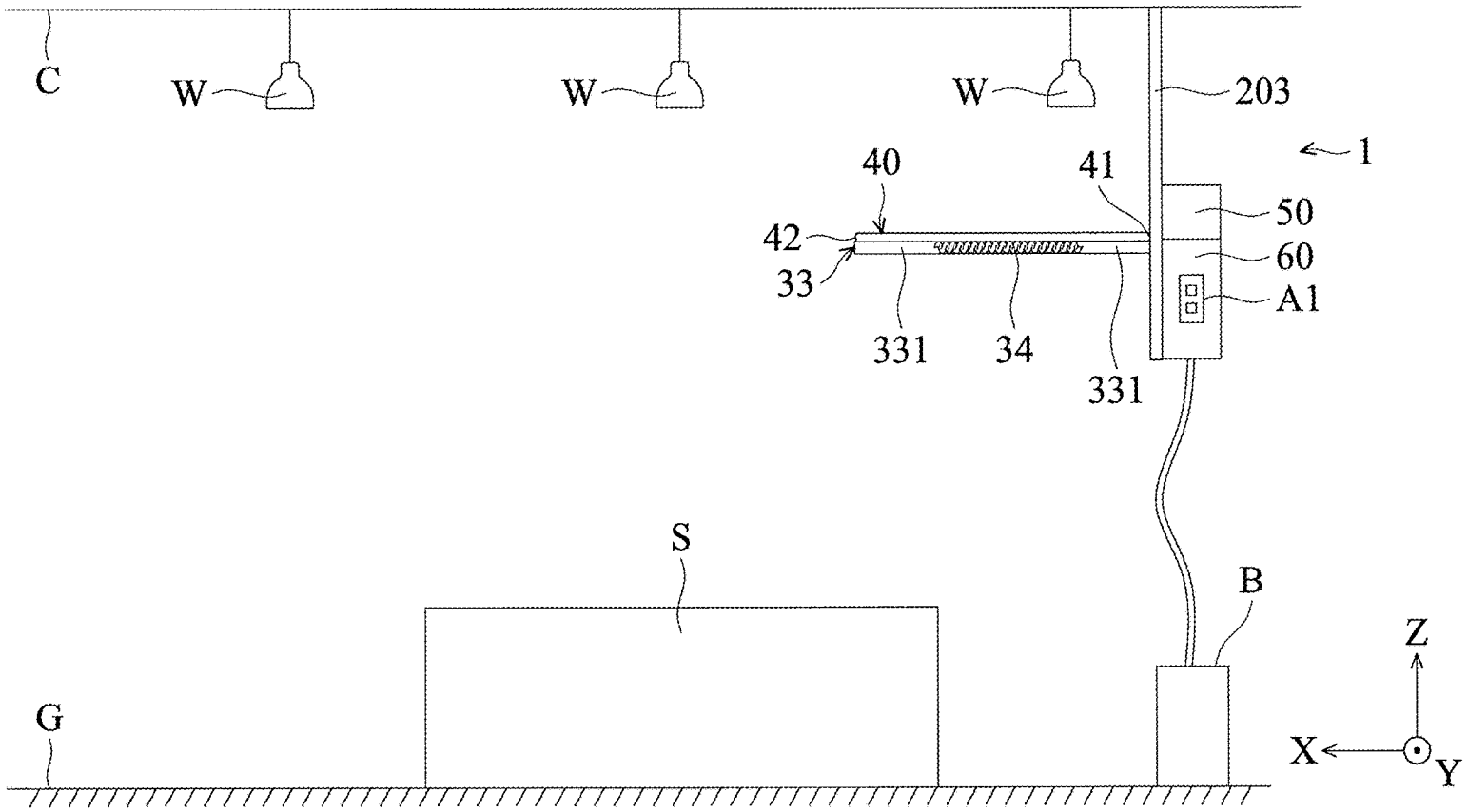
FIG. 3C is a front view of the protection device, the equipment, and the earthquake sensor in FIG. 3A.

Referring to FIGS. 3A-3C, FIG. 3A is a perspective view of a protection device 1, equipment S, and an earthquake sensor B according to another embodiment of the invention, and FIGS. 3B and 3C are a top view and a front view of the protection device 1, the equipment S, and the earthquake sensor B in FIG. 3A. As shown in FIGS. 3A-3C, the equipment S is disposed on the floor G, and the protection device 1 primarily comprises two fixed members 203, two linkage mechanisms 33, two retractable members 34, an awning 40, an electromagnetic device 50, and a power supply unit 60. The fixed members 203 are disposed on the ceiling C and situated on a side of the equipment S (FIG. 3C), and the linkage mechanisms 33 are disposed above the equipment S and connected to the fixed members 203.

It should be understood that the linkage mechanism 33 has a V-shape structure formed by two rods 331 pivotally connected with each other, and the linkage mechanism 33 has magnetic material. The retractable member 34 is connected between the rods 331 of the linkage mechanism 33, and the awning 40 is disposed on the linkage mechanisms 33 and remains in a received state. Referring to FIG. 3C, the electromagnetic device 50 and the power supply unit 60 are disposed on a side of the fixed member 203, wherein the power supply unit 60 can provide electrical power to the electromagnetic device 50, so that the electromagnetic device 50 attracts the linkage mechanisms 33 to retain the awning 40 in the received state, as shown in FIGS. 3A-3C.

In this embodiment, the retractable member 34 is a compression spring compressed between the two rods 331 of the linkage mechanism 33. Referring to FIG. 3B, when the awning 40 is in the received state, the two rods 331 of the linkage mechanism 33 form an acute angle therebetween. The first side 41 of the awning 40 is fixed to the fixed member 203, and the second side 42 of the awning 40 is fixed to the linkage mechanism 33, wherein the second side 42 is opposite to the first side 41. The power supply unit 60 has a first switch A1 to control the power supply unit 60 to provide electrical power to the electromagnetic device 50 or not.

Figure 3D:
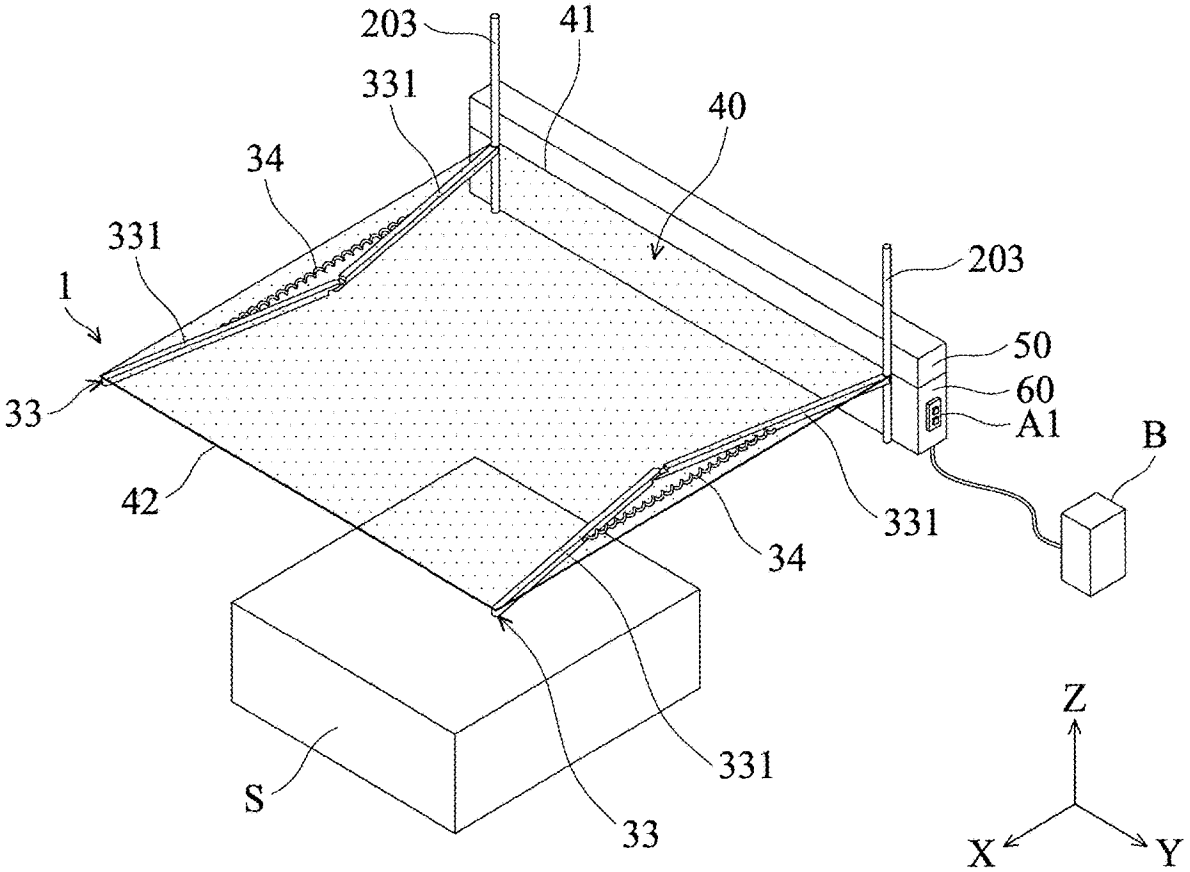
FIG. 3D is a perspective view of the protection device with the awning expanded, the equipment, and the earthquake sensor in FIG. 3A.
Figure 3E:
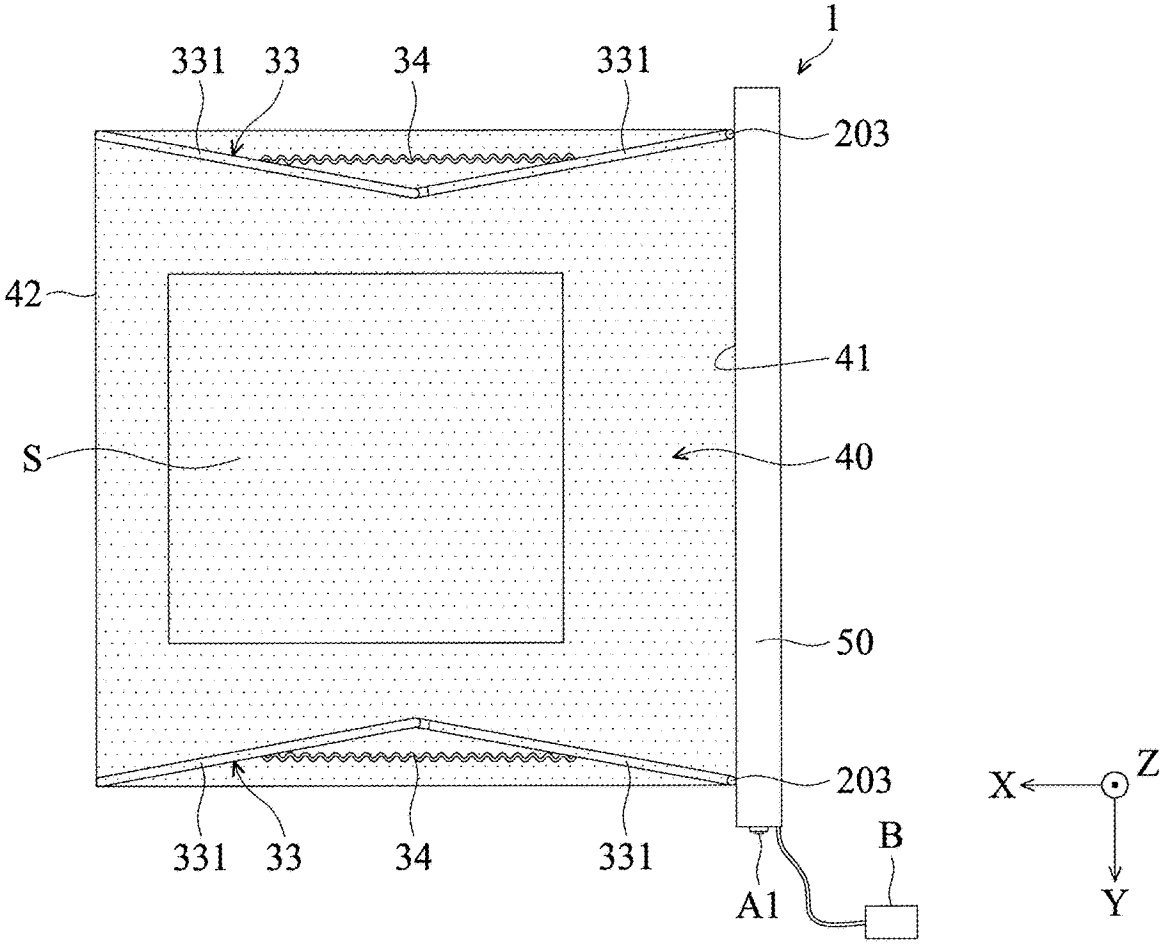
FIG. 3E is a top view of the protection device, the equipment, and the earthquake sensor in FIG. 3D.
Figure 3F:
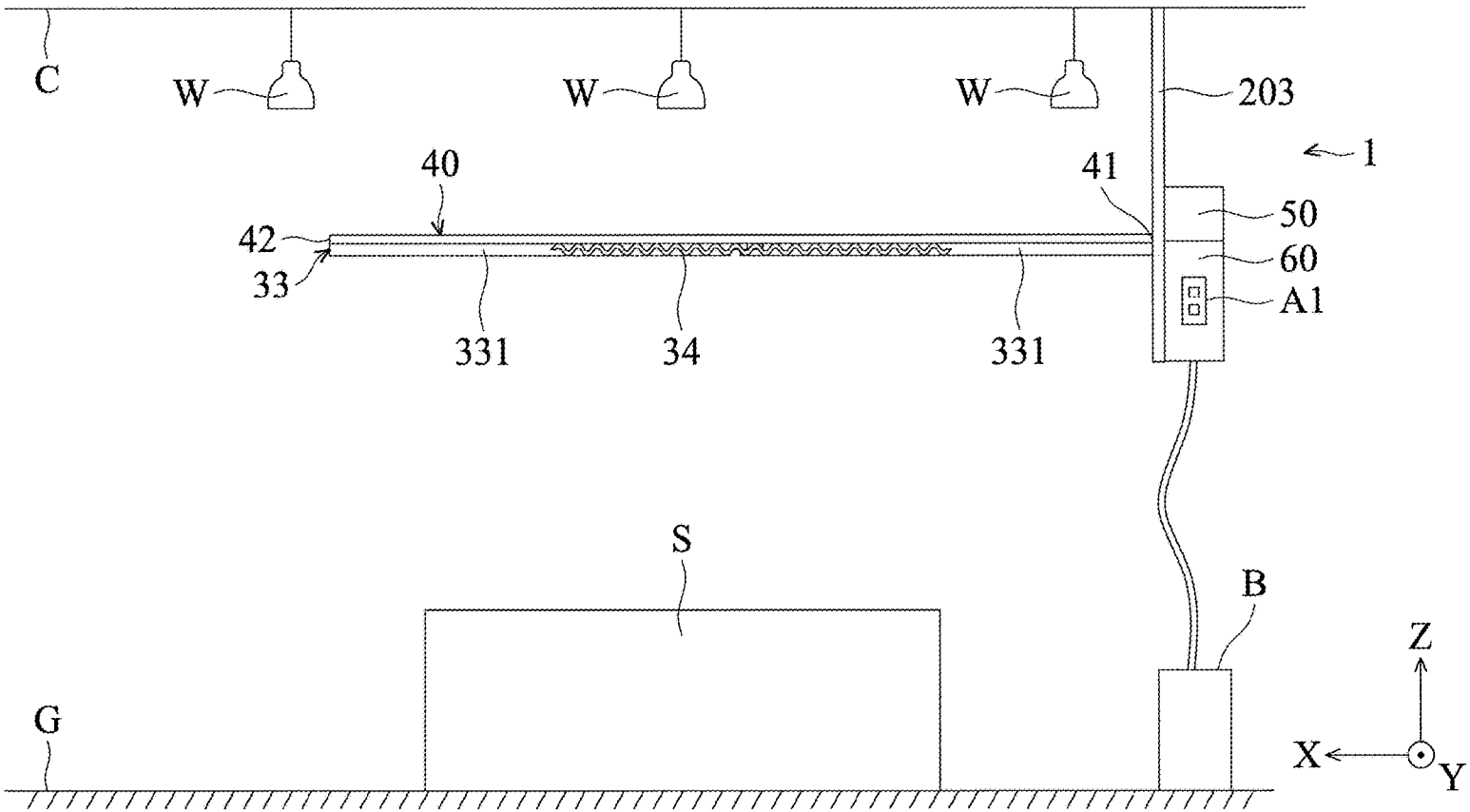
FIG. 3F is a front view of the protection device, the equipment, and the earthquake sensor in FIG. 3D.

Referring to FIGS. 3D-3F, FIG. 3D is a perspective view of the protection device 1 with the awning 40 expanded, the equipment S, and the earthquake sensor B in FIG. 3A, and FIGS. 3E and 3F are respectively a top view and a front view of the protection device 1, the equipment S, and the earthquake sensor B in FIG. 3D. As shown in FIG. 3E, when the power supply unit 60 stops providing electrical power to the electromagnetic device 50, the retractable member 34 expands the two rods 331 of the linkage mechanism 33 with an acute angle formed therebetween.

In addition, the power supply unit 60 in this embodiment is electrically connected to the earthquake sensor B. When the earthquake sensor B detects a seismic intensity greater than a specific value, the earthquake sensor B transmits a signal to the power supply unit 60, and the power supply unit 60 stops providing electrical power to the electromagnetic device 50. Therefore, the magnetic force between the electromagnetic device 50 and the linkage mechanism 33 is released, and the retractable member 34 expands the linkage mechanism 33 and the awning 40 to cover the equipment S, so as to prevent liquid or dust from intruding into the equipment S.

For example, the awning 40 may include a non-combustible and non-combustion-supporting material, such as glass fabric material. The equipment S can be any equipment which should be protected from liquid or dust, and a plurality of sprinklers W may be disposed on the ceiling C above the protection device 1. When an earthquake with a seismic intensity greater than 4 scales occurs and causes leakage of the liquid in the fire pipe of the sprinkler W, the operator can manually turn off the power supply unit 60 through the first switch A1. Alternatively, the power supply unit 60 can stop providing electrical power to the electromagnetic device 50 by receiving a signal from the earthquake sensor B, such that the awning 40 can be expanded to cover the equipment S by the method previously mentioned.

It should be understood that the fixed member 203 is not limited by this embodiment that it should be fixed to the ceiling C, and the fixed member 203 can also be fixed to the floor G. Moreover, the numbers of the fixed members 203, the linkage mechanisms 33, and the retractable members 34 are not limited to two in this embodiment. The number of these members can be one, three, or more, and the retractable member 34 may have a cylinder or another expandable mechanism.

Figure 4:
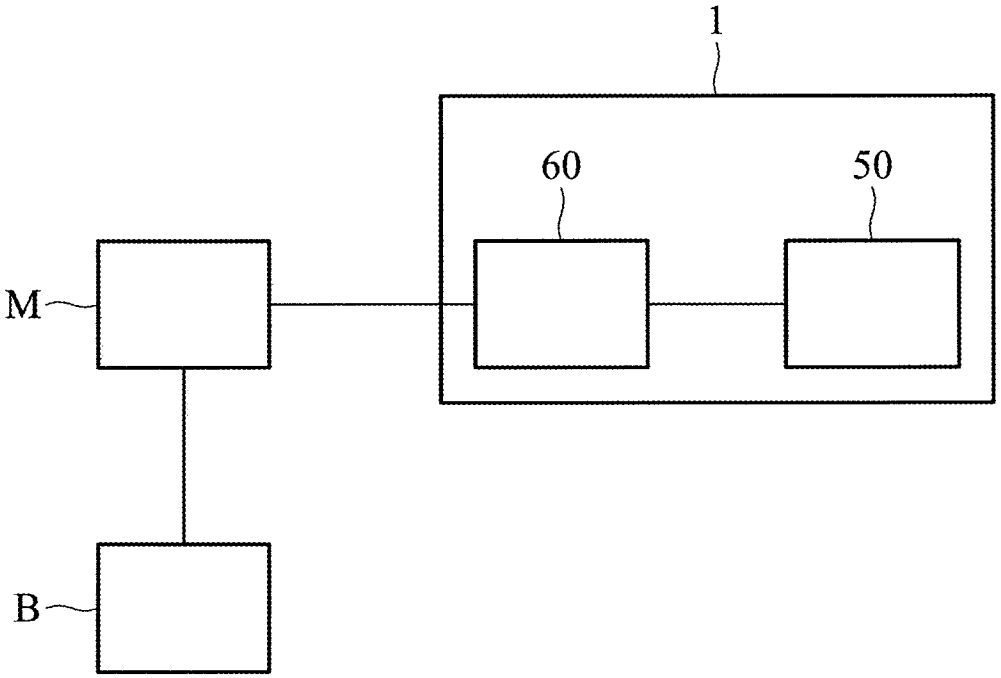
FIG. 4 shows an equipment protection system according to an embodiment of the invention.

FIG. 4 shows an equipment protection system according to an embodiment of the invention. As shown in FIG. 4, the equipment protection system comprises at least one protection device 1 as well as the previously mentioned embodiments, a power source M, and an earthquake sensor B, wherein the power source M is electrically connected to the earthquake sensor B and the power supply unit 60 of the protection device 1. The power source M can provide electrical power to the power supply unit 60, so that the power supply unit 60 supplies electrical power to the electromagnetic device 50, and the electromagnetic device 50 can hold the awning 40 in the received state.

For instance, when the earthquake sensor B detects a seismic intensity greater than a specific value, the earthquake sensor B transmits a signal to the power source M, so that the power source M stops providing electrical power to the power supply unit 60. It should be understood that the power source M can also be electrically connected to a different power supply unit 60 of a plurality of the protection device 1, respectively. Therefore, when the power source M receives a signal from the earthquake sensor B, it can stop providing the electrical power to the power supply unit 60. Thus, the equipment protection system can utilize the protection device 1 to turn off the power source M according to the signal from the earthquake sensor B, or the power source M can be turned off manually, so that the power source M stops providing electrical power to the power supplies 60, and the awning 40 can automatically cover the equipment S.

In summary, the invention provides a protection device, wherein when the power supply unit supplies electrical power to an electromagnetic device, the awning is held in the received state. When the power supply unit stops providing electrical power to the electromagnetic device, the awning expands to cover the equipment which should be protected from liquid and dust. Therefore, the fire can be promptly extinguished by the sprinkler when the fire occurs, and the operation of the protection device can also be automatically actuated even when no operator is present, so as to achieve the function of water-proofing and dust-proofing. In other words, the invention can help the equipment meet the requirements of fire safety regulations and prevent the equipment from becoming damaged due to the intrusion of liquid.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

While the invention has been described by way of example and in terms of the preferred embodiments, it should be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A protection device for equipment disposed on a floor, comprising:

at least one first fixed member;

at least one second fixed member, substantially parallel to the first fixed member;

a supporting structure, connected to and angled with respect to the at least one first and second fixed members;

a roller, movably disposed on the supporting structure, and having magnetic material;

an awning, wound on the roller and situated in a received state, wherein a first side of the awning is fixed to the at least one first fixed member, a second side of the awning is fixed to the roller, and the second side is opposite to the first side;

an electromagnetic device, disposed on a side of the at least one first fixed member; and a power supply unit, providing electrical power to the electromagnetic device, so that the electromagnetic device attracts the roller, and the awning remains in the received state, wherein when the power supply unit stops providing electrical power to the electromagnetic device, the roller moves along the supporting structure due to gravity, and the awning is expanded to cover the equipment.

2. The protection device as claimed in claim 1, wherein the protection device comprises two first fixed members and two second fixed members, and the supporting structure has four supporting members, wherein the supporting members form a rectangle area above the equipment.

3. The protection device as claimed in claim 1, wherein the awning has glass fabric material.

4. The protection device as claimed in claim 1, wherein the supporting structure forms an acute angle with respect to the at least one first fixed member.

5. The protection device as claimed in claim 1, wherein the at least one second fixed member has a restricting portion protruding from the supporting structure to restrict the roller and prevent the roller from falling to the floor.

6. A protection device for equipment disposed on a floor, comprising:

a fixed member;

a linkage mechanism, connected to the fixed member, wherein the linkage mechanism has magnetic material;

a retractable member, connected to the linkage mechanism;

an awning, disposed on the linkage mechanism and situated in a received state, wherein a first side of the awning is fixed to the fixed member, a second side of the awning is fixed to the linkage mechanism, and the second side is opposite to the first side;

an electromagnetic device, disposed on a side of the fixed member; and a power supply unit, providing electrical power to the electromagnetic device, so that the electromagnetic device attracts the linkage mechanism, and the awning remains in the received state, wherein when the power supply unit stops providing electrical power to the electromagnetic device, the retractable member expands the linkage mechanism, and the awning is expanded to cover the equipment.

7. The protection device as claimed in claim 6, wherein the awning has glass fabric material.

8. The protection device as claimed in claim 6, wherein the protection device further comprises an additional fixed member, an additional linkage mechanism, and an additional retractable member, wherein the linkage mechanism and the additional linkage mechanism connect to the fixed member and the additional fixed member respectively, the retractable member and the additional retractable member respectively connect to the linkage mechanism and the additional linkage mechanism, and the awning is disposed on the linkage mechanism and the additional linkage mechanism and has a rectangle structure.

9. An equipment protection system, comprising:

the protection device as claimed in claim 1;

a power source, electrically connected to the power supply unit of the protection device; and an earthquake sensor, electrically connected to the power source, wherein when the earthquake sensor detects a seismic intensity greater than a specific value, the earthquake sensor transmits a signal to the power source, and the power source stops providing electrical power to the power supply unit.

10. The equipment protection system as claimed in claim 9, wherein the equipment protection system comprises a plurality of the protection devices, and the power source electrically connects to the power supply units of each of the protection devices, wherein when the earthquake sensor detects a seismic intensity greater than a specific value, the earthquake sensor transmits a signal to the power source, and the power source stops providing electrical power to the power supply units.

* * * * *